United States Patent [19]

Sideman et al.

[11] 4,171,202

[45] Oct. 16, 1979

[54] SHEET CONTAINING SUBLIMABLE DYE AND BLOCKING REAGENT FOR HEAT TRANSFER PRINTING

[75] Inventors: Carl E. Sideman, Lunenburg; Thomas E. Lewis, Gardner, both of Mass.

[73] Assignee: Litton Business Systems, Inc., Fitchburg, Mass.

[21] Appl. No.: 861,422

[22] Filed: Dec. 16, 1977

[51] Int. Cl.[2] ..... D06P 5/00; D06P 5/06

[52] U.S. Cl. ..... 8/2.5 A; 8/2.5 R; 106/22; 428/913

[58] Field of Search ..... 8/2.5 R, 2.5 A

[56] References Cited

U.S. PATENT DOCUMENTS 3,940,246 2/1976 DeFago et al. ..... 8/2.5 A

FOREIGN PATENT DOCUMENTS 1391012 4/1975 United Kingdom .

*Primary Examiner*—Stanford M. Levin

*Attorney, Agent, or Firm*—Cooper, Dunham, Clark, Griffin & Moran

[57] ABSTRACT

This invention concerns transfer sheets which include a blocking agent and which are useful in the heat transfer dye printing of various materials such as textiles. The blocking agent is capable of chemically reacting with and thereby completely or partially blocking the transfer of heat transfer dyes which have been previously imprinted or coated on the transfer sheets. By using such transfer sheets, designs can be printed which are not otherwise obtainable by conventional techniques. The invention further concerns the method of making such sheets, their use in the printing of various materials, and the materials which have been so printed.

16 Claims, 3 Drawing Figures

SHEET CONTAINING SUBLIMABLE DYE AND BLOCKING REAGENT FOR HEAT TRANSFER PRINTING

BACKGROUND OF THE INVENTION

It is known to print textiles and other materials, particularly synthetic fabrics, by heat transfer dye printing using sublimable or vaporizable dyes which have been imprinted in a pattern or design upon a substrate such as paper. Heat transfer printing has been described in French Pat. No. 1,223,330 and in Swiss Pat. No. 476,893. Such printing techniques, however, are subject to limitations. Thus, it is particularly difficult, and in some cases impossible, to obtain certain complicated patterns or designs involving multicolored combinations of dyes.

In printing heat transfer dyes on a substrate to form a multicolored design to be transferred, differently colored dyes are successively deposited on the substrate. When these successive deposits overlap, stronger, darker prints are formed because, when dye is printed over dye, each dye reinforces the color developed by the other. White is produced by printing no color where white is desired, and when fine white lines are required, a printing press must have printing stages exactly in register so that successive imprinting of differently colored dyes do not print in the fine white line area. Further, certain shading effects in which lighter and darker shades of the same color are sought can be difficult to obtain for some patterns.

These disadvantages are overcome by the present invention which utilizes a blocking agent capable of chemically reacting with the heat transfer dyes thereby binding the same to the substrate. The dye thus immobilized cannot be heat transferred to the article to be printed. By the use of such blocking agents, complicated patterns and designs can be economically and efficiently produced in which the transfer of the dye is partially or completely blocked thereby allowing lighter shades or no color to be produced over darker shades. It also allows for greater utilization of printing cylinders because from a given set of cylinders, a series of positive prints and a series of negative prints can be made without making additional engravings.

British Pat. No. 1,391,012 describes the use of a physical barrier layer consisting of a proteinaceous coating. While a physical barrier is capable of preventing sublimed dye from passing there through, the effectiveness of the barrier is dependent on the density and the heat stability of the barrier. Moreover, it must overlie the dye.

The blocking agent of the present invention is effective when deposited underneath as well as above the dye as it not only acts as a physical barrier but functions to chemically react with the dye and this will, to an extent, bind dye lying immediately above it. Further, in accordance with the present invention, heat transfer dyes can be selected so that one is reactive with the blocking agent while a second is non-reactive. This allows for a continuous overcoating of blocking agent which is capable of selectively allowing a dye to pass there through. Still further, the present invention is heat stable as its chemical reactivity is increased with heat.

A still further feature of the present invention is that a blocking agent can be incorporated in an ink which contains a dye with which it is non-reactive. This ink is then deposited over an ink containing a dye which is reactive with the blocking agent. As a result, the dye incorporated in the blocking agent is transferred but the dye below the blocking agent is blocked.

SUMMARY OF THE INVENTION

This invention provides a structure useful for heat transfer dye printing. The structure comprises a substrate, such as a paper sheet, on one surface of which at least one heat transferable dye has been imprinted or coated and a blocking agent which has been deposited on or underneath at least a portion of said dye. The portion of the imprinted or coated dye in contact with the blocking agent is partially or completely blocked from being heat transferred.

In another embodiment, this invention provides a process for preparing the structure useful for heat transfer dye printing which comprises imprinting or coating at least one heat transferrable dye on one surface of a substrate and depositing a blocking agent in contact with at least a portion of said imprinted dye. In still another embodiment, this invention provides a process for heat transfer dye printing which comprises heating the structure, on which dye has been imprinted or coated and blocking agent deposited, together with a material to be printed. The structure and the material to be printed are placed adjacent to or in contact with one another and heated to a temperature at which the deposited dye sublimes or vaporizes or otherwise transfers so that the dye is transferred to the material to be printed with the dye in contact with the blocking agent being partially or completely prevented from transferring.

In still another embodiment, this invention provides printed materials prepared in accordance with the process described herein.

These and other embodiments of this invention will be understood more clearly by reference to the accompanying drawings and detailed description of the invention.

DETAILED DESCRIPTION OF THE INVENTION

Specifically, this invention provides structures useful for heat transfer dye printing of various materials, especially synthetic textile fabrics. The structure of this invention comprises a substrate on one surface of which one or more heat transferrable dyes have been imprinted or coated. In addition, a blocking agent is deposited on or below at least a portion of the imprinted or coated dye or dyes. Various substrates including plastic films and metal foils are usefully employed in the practices of this invention but paper is particularly preferred. The substrate may be in the form of continuous roll or sheet and may be rigid or flexible.

Figure 1:
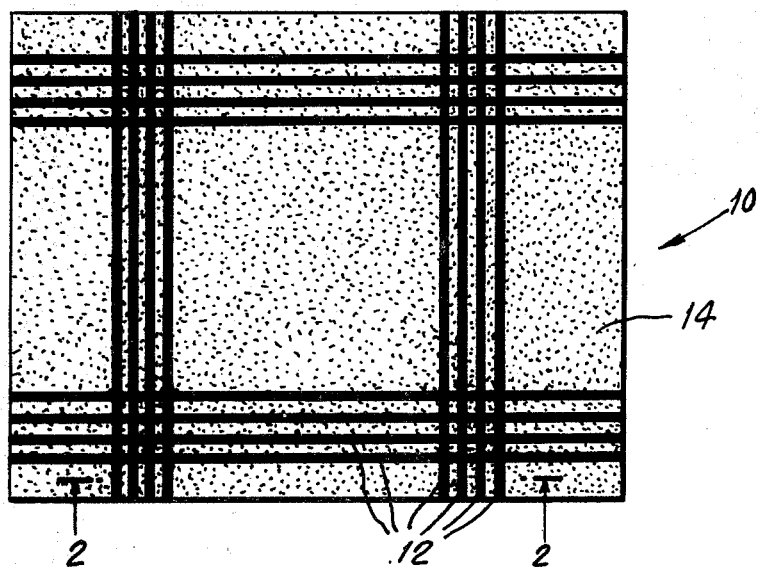
FIG. 1 is a partial planar view of a dye transfer sheet in accordance with this invention which includes an imprinted dye upon a portion of which blocking agent has been deposited.

Paper transfer sheets, shown as 10 in FIG. 1, are particularly useful as substrates. After imprinting with dye 14 and depositing blocking agent 12 on substrate 16, the sheets can be rolled and stored for later use in the heat transfer dye printing of various materials. The blocking agent 12 and dye 14 of this invention, shown in cross-sectional view in FIG. 2, can be printed by diverse printing techniques, such as, for example, gravure, flexographic, letter press, rotary screen, etc. In addition, dye 14 and blocking agent 12 may be coated as well as printed by various diverse coating techniques, such as reverse roll, air knife, trailing blade, etc.

Figure 2:
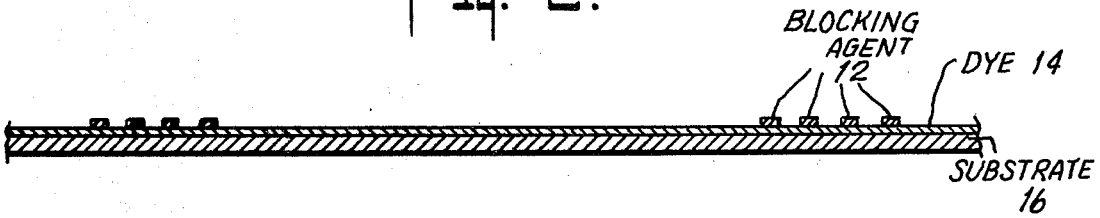
FIG. 2 is a section taken substantially along the line 2—2 of FIG. 1.

While the blocking agent 12 is shown in FIG. 2 overlying the dye 14, it is to be understood that the blocking agent 12 may be deposited directly on substrate 16 with dye 14 overlying the same. In this instance, however, the blocking agent 12 will only partially block transfer of the dye.

The heat transferrable dyes useful in this invention are dyes which sublime or vaporize or otherwise convert to a mobil phase in a range of 160° to 240° C. at or around atmospheric pressure. In vacuum transfer, dyes which convert to a mobil phase at a temperature lower than 160° C. can be used.

The heat transfer dyes used in the present invention are commonly referred to as disperse dyes but this terminology describes the way the dyes are used rather than a class or classes of dyes. Heat transfer dyes which are capable of being heat activated to a mobil phase in the aforesaid temperature range can be selected from nitroso, nitro, monoazo, disazo, trisazo, polyazo, stilbene, carotenoid, diphenylmethane, triarylmethane, xanthene, acridine, quinoline, methine, thiazole, indamine, indophenol, azine, oxazine, thiazine, sulphur, lactone, aminoketone, hydroxyketone, anthraquinone, indigoid, and phthalocyanine dyes.

Dyes which include one or more polar functional groups such as —$NH_2$ or —OH or —$SO_2NH_2$ are preferred, but the particular choice will depend on its chemical reactivity with the blocking agent employed.

The following are examples of heat transferrable dyes which have been found useful in the practice of this invention:

1-Amino-4-Hydroxyanthraquinones

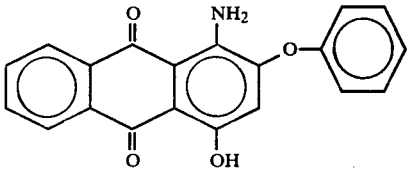

Disp Red 60

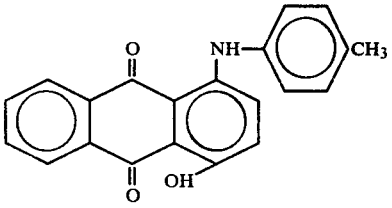

Disp Blue 72

1,4-Diaminoanthraquinones

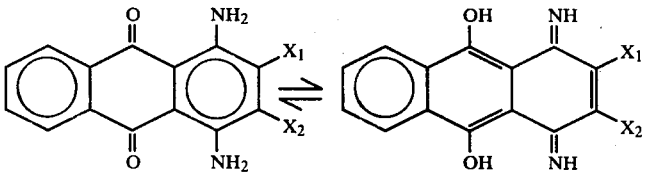

$X_1=X_2=H$ Disp Violet 1
$X_1=X_2=Cl$ Disp Violet 28

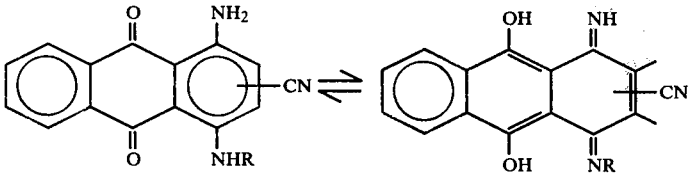

Holiday's Subprint Blue 70032
or
Crompton & Knowles Intratherm Blue P-305

Azo Dyes

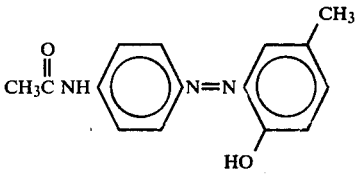

Disp Yellow 3

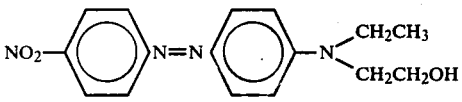

Disp Red 1

-continued
Disp Yellow 23
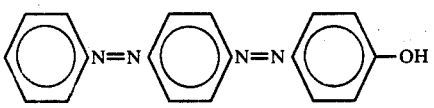
Solvent Brown 1
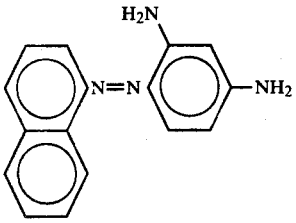
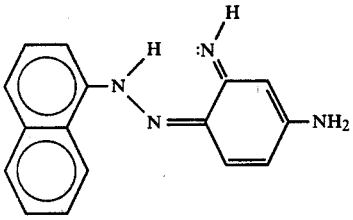
TRIARYLMETHANE
BASIC BLUE 1 BASE
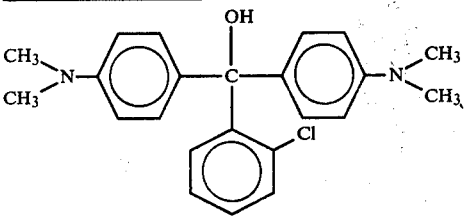
DIPHENYLAMINE OR "NITRO"
DISP YELLOW 33
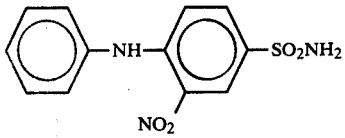
QUINOPHTHALONE
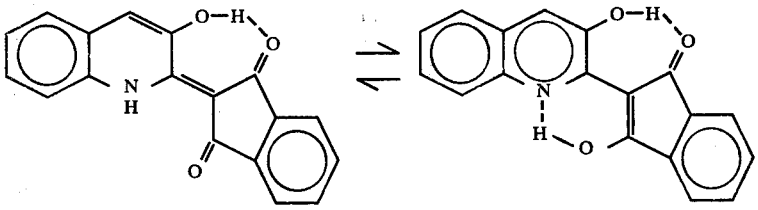
DISP YELLOW 54
PERINONE
SOLVENT ORANGE 60
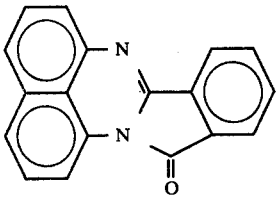
THIOINDIGOID
VAT RED 41
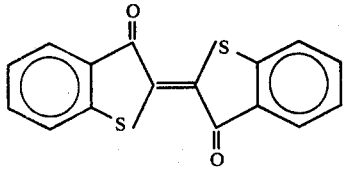

-continued

METHINE

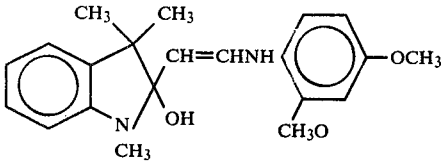

BASIC YELLOW 11 BASE

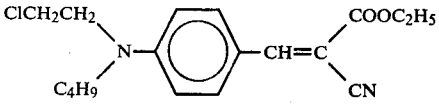

DISP YELLOW 31

The inks containing the heat transferable dyes will be formulated so as to be appropriate to the printing or coating method employed. Selection of binders, solvents, extenders are matters well within the skill of a chemist in the art. For example, a gravure heat transfer ink could comprise a heat transfer dye dispersed in a vehicle composed of ethyl cellulose dissolved in ethyl alcohol vehicle. Likewise, a water-based flexographic heat transfer ink could be prepared by dispersing a heat transfer dye in a vehicle composed of an acrylic resin dissolved in a water and an isopropanol blend. A hot melt coating may be prepared by dispersing the dye in a high melting wax mixture. A rotary screen ink could be prepared by using a dispersed dye paste compounded with a thickening agent and water.

The selection of the blocking agent is a matter within the skill of a chemist in the art as once the heat transfer dye is selected, a blocking agent can be selected from a wide range of compounds known to chemically react with the dye. The dye may be permanently bound by various mechanisms such as reactions which immobilize the dye, or other reactions which destroy or convert the dyes to a non-colored form. For example, any dye chemist would know that many anthraquinone dyes may be reduced to a water-soluble, ionic, colorless form by treatment with hydrosulphite. Accordingly, hydrosulphite could be used to block anthraquinone dyes. Reactive reagents such as isocyanates can be used as a blocking agent to block dyes containing hydroxyl functionality.

Since aminoplasts are capable of chemically reacting with and immobilizing a broad range of dyes with functional groups such as $—NH_2$ or —OH or $—SO_2NH_2$, this class is preferred. The aminoplasts include, for example, urea formaldehyde, methylated urea formaldehyde, melamine formaldehyde, methylated melamine formaldehyde, and glyoxal formaldehye.

Epoxy resins have also been found to have a broad range of application as a blocking agent particularly with dyes having amino functional groups.

Melamine based compounds having a particularly large range of application as blocking agents are represented by the following formula:

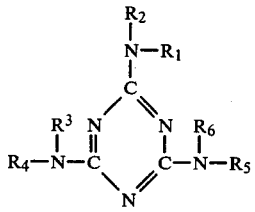

Wherein $R_1$, $R_2$, $R_3$, $R_4$, $R_5$, $R_6$, may be the same or different, each of which may represent a hydrogen, a $C_1$–$C_6$ alkyl, a methylol ($—CH_2OH$) a methoxymethyl ($CH_3OCH_2$—), or a $C_2$–$C_6$ alkoxymethyl (n-butoxy methyl: $CH_3CH_2CH_2CH_2OCH_2$— for example) with the proviso that at least one of $R_1$, $R_2$, $R_3$, $R_4$, $R_5$, or $R_6$ is a methylol ($—CH_2OH$), methoxymethyl ($CH_3OCH_2$—) or a higher alkoxymethyl. Especially prefered as a blocking agent is hexamethoxymethylmelamine.

Urea based compounds may be of the following formula:

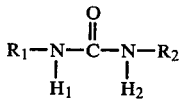

Wherein $R_1$ and $R_2$ may be the same or different, each of which may represent a hydrogen, a $C_1$–$C_6$alkyl, a methylol ($—CH_2OH$) and methoxymethyl ($CH_3OCH_2$—) or $C_2$–$C_6$ alkoxymethyl (n-butoxy methyl: $CH_3CH_2CH_2CH_2OCH_2$— for example) with the proviso that either $R_1$ or $R_2$ is a methylol ($—CH_2OH$), a methoxymethyl ($CH_3OCH_2$—) or a higher alkoxymethyl.

It is possible to replace $H_1$ and $H_2$ above with alkyls. Dimethylolethyleneurea indicated below is one possible modification.

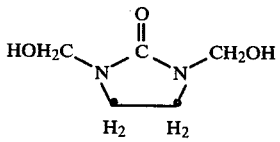

Glyoxal based compounds may be of the following formula:

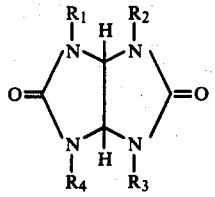

wherein $R_1$, $R_2$, $R_3$, and $R_4$, may be the same or different, each of which may represent a hydrogen, a $C_1$–$C_6$ alkyl, a methylol (—$CH_2OH$), methoxymethyl ($CH_3OCH_2$—) or a $C_2$–$C_6$ alkoxymethyl (n-butoxy methyl: $CH_3CH_2CH_2CH_2OCH_2$— for example) with the proviso that at least one of $R_1$, $R_2$, $R_3$, or $R_4$ is a methylol (—$CH_2OH$), methoxymethyl ($CH_3OCH_2$—) or a higher alkoxymethyl.

The blocking agent is deposited as a layer using any conventional printing technique such as gravure, flexographic, letter press, etc. Depending on the printing method employed, the blocking agent optionally has carrier, extender, and solvent added thereto.

In addition, catalysts may be added depending on the chemistry of the blocking agent to be employed. For example, an acidic catalyst will be added when an aminoplast is to be used.

The carrier or the components of the carriers, as well as the solvents and extenders are well known to chemists in the various printing fields. When, for example, gravure printing is employed to deposit the blocking agent and the blocking agent is one of the aminoplasts referred to above, cellulose derivatives are particularly useful as carriers: Examples of such carriers include cellulose acetate butyrate, cellulose acetate propionate, ethyl cellulose, and nitrocellulose. Vinyl and vinyl copolymer resins, acrylic and acrylic copolymer resins, alkyd resins (drying and non-drying), and chlorinated rubbers are also suitable.

Since the blocking agents of this invention are ordinarily colorless, it is oftentimes desirable to include in the layer a colored non-heat transferrable dye as a marker to indicate the location of the blocking agent after it has been deposited on the imprinted dye. A charged cationic dye, such as a Victoria Blue, and carbon black are useful in this regard.

The structures of this invention as shown in FIG. 1 can be prepared by imprinting or coating at least one heat transferrable dye on one surface of a substrate and depositing a blocking agent on at least a portion of the imprinted dye. In the alternative, the blocking agent can be deposited first and the dye deposited thereover, but in this instance, the dye will only be partially blocked.

The structures can then be used in the printing of various materials. For textiles, materials prepared from synethetic fibers such as polyesters, polyamides, and acrylics are particularly receptive to heat transfer dyes. When appropriate pretreatments are used, cellulosics and cellulosic containing blends may be used. Wood, films, and metals, provided with a dye-receptive coating are also suitable for printing.

Heat transfer printing is effected by heating the structure and the material to be printed, both of which have been placed together to a temperature of 160° and 240° C. for a sufficient period of time to allow the heat transferable dye to convert to a mobile phase and then to move to the material which is being printed. The blocking agent undergoes a chemical reaction with at least a portion of the dye upon which it has been deposited. This reaction takes place both or either at the time of deposit of the blocking agent in contact with the dye and/or during the heating process when the unreacted dye is mobilized into the layer containing the blocking agent. The reacted dye is immobilized and therefore is not transferred. The extent of this reaction depends upon the nature of the dye used and the concentration of the blocking agent in the layer deposited on or under the dye. By varying the concentration, complete blockage of dye transfer or partial blockage to produce shading effects can be obtained. Complete blockage occurs when there is sufficient concentration of blocking agent overlying the dye to completely react with all the dye attempting to pass there through.

Figure 3:
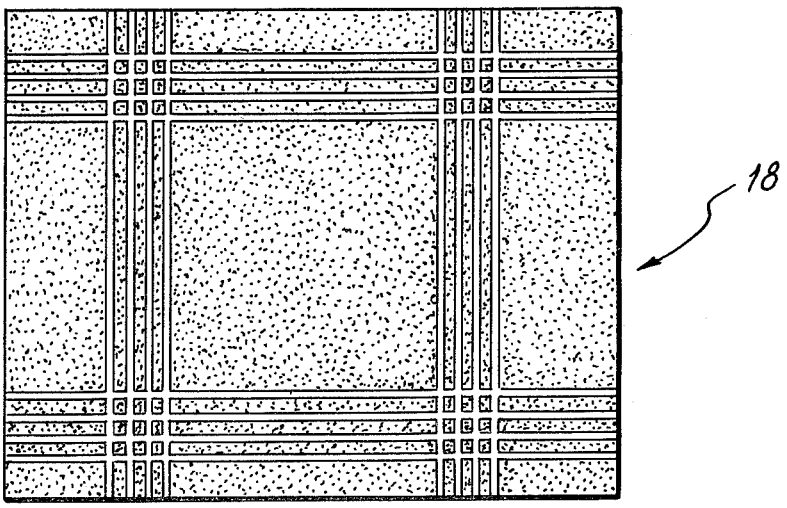
FIG. 3 is a partial planar view of a material which has been printed using the transfer sheet of FIG. 1.

A printed material such as a synthetic textile fabric prepared in accordance with this process is shown as 18 in FIG. 3.

The invention also has application to a heat transfer process commonly know as the dew print process decribed and illustrated on pages 71 and 72 of the October 1975 issue of "Textile Month's" published by Textile Business Press, Ltd., Staham House, Talbot Road, Stretford, Manchester, Great Britain wherein a water saturated fabric to be printed is brought in contact with a printed sheet containing dyestuff appropriate to the fabric. The dye dissolves in the water and migrates to the fabric.

The following examples are set forth hereinafter to illustrate the invention more fully but are not intended in any way to limit the scope thereof. Parts and percentages are expressed by weight unless an indication to the contrary is given.

EXAMPLE 1

An ink is prepared comprising about 16 percent Disp Yellow 23. The ink is imprinted on a paper sheet to completely cover its surface. A blocking agent is then deposited on a portion of the imprinted ink in the form of an organic layer having the following composition:

| | |
|---|---|
| Hexamethyloxymethylmelamine | 33.3% |
| Nitrocellulose (70% solid in isopropanol alcohol) | 16.7% |
| Solvent (one part ester/one part alcohol/ one part toluol) | 45.0% |
| Para-toluene sulphonic acid (50% solution in alcohol) | 5.0% |

The sheet on which the dye has been imprinted and the blocking agent deposited is then used to heat transfer print a polyester fabric. Essentially complete blockage of dye transfer is obtained from that portion of the sheet or dye on which the blocking agent had been deposited.

EXAMPLE 2

An ink is prepared which contains 16 percent Disp Red 1 dye. This is imprinted on a paper sheet so as to cover its surface. Blocking agent is then deposited on a portion of the ink in the form of a layer having the following composition:

| | |
|---|---|
| Hexamethoxymethylmelamine | 42.0% |
| Ethyl Cellulose - 4 C.P.S. | 8.0% |
| Solvent (one part ester/one part alcohol/one part toluol) | 40.0% |

-continued

| | |
|---|---|
| Para-toluene sulphonic acid (50% solution in alcohol) | 10.0% |

A fabric is then used to heat transfer print a nylon fabric. Essentially complete blockage of dye transfer is obtained.

EXAMPLE 3

The concentration of hexamethoxymethylmelamine in Example 2 is reduced to 6 percent by adding an ethyl cellulose solution (10 percent solids in the solvent blend of Example 2). About 65 percent of dye transfer is blocked.

EXAMPLE 4

$N_1N_2$— Dimethoxymethylurea was substituted for the hexamethaxymethylmelamine of Example 1. Nearly complete blockage of the dye transfer was obtained.

EXAMPLE 5

The same as Example 1 except that the ink was deposited over the blocking agent. About 50 percent of the dye was blocked.

EXAMPLE 6

An ink is prepared comprising 16 percent Holiday Subprint Blue 70032. The ink is imprinted on paper to completely cover its surface. Blocking agent is then deposited on a portion of the imprinted ink in the form of a layer having the following composition:

| | |
|---|---|
| Epon 1007 (epoxy resin) | 30% |
| Solvent (one part cellosolve/ one part toluol/one part methylethyl ketone) | 67% |
| Para-toluene sulphonic acid (50% solution in alcohol) | 3% |

The sheet on which the dye has been imprinted and the blocking agent deposited is then used to heat transfer print a sheet of polyester film. A partial blockage of dye transfer is obtained from that portion of the sheet or dye on which the blocking agent has been deposited.

As will be obvious to one skilled in the art, many modifications and variations are possible in this invention without departing from the scope and spirit thereof as set forth more fully in the claims which follow.

We claim:

1. A structure useful for heat transfer dye printing which comprises a substrate, at least one heat transferable dye on one surface of said substrate and a blocking agent deposited on or below at least a portion of said dye, said blocking agent being chemically reactive with at least one of said heat transferable dyes.

2. The structure of claim 1 wherein said chemically reactive blocking agent reacts with at least one of said dyes upon the application of heat to said structure.

3. The structure of claim 1 wherein a plurality of dyes are deposited on said surface and at least one of the dyes deposited on said surface does not chemically react with said blocking agent.

4. The structure of claim 1 wherein said heat transferable dye is a dye which sublimes or vaporizes at a temperature in the range from about 160°–240° C.

5. The structure of claim 4 wherein said dye is an azo dye.

6. The structure of claim 4 wherein said dye is an anthraquinone dye.

7. The structure of claim 1 wherein said blocking agent is an aminoplast.

8. The structure of claim 7 wherein said blocking agent is hexamethoxymethylmelamine.

9. The structure of claim 1 wherein said blocking agent is deposited as a layer comprising the blocking agent, a carrier and a solvent.

10. The structure of claim 9 wherein said layer additionally comprises a catalyst.

11. The structure of claim 10 wherein said catalyst is acidic or acidic-acting and said blocking agent is an aminoplast.

12. The structure of claim 11 wherein said catalyst is p- toluenesulfonic acid.

13. The structure of claim 9 wherein said layer further comprises a colored non-heat transferable dye as a marker to indicate the location of the blocking agent.

14. A process for heat transfer dye printing which comprises placing the structure of claim 1 in contact with a material to be printed, and heating said structure to a temperature in the range 160° to 240° C. for a sufficient period of time to allow the heat transferable dye which is not in contact with the blocking agent to transfer onto said material.

15. The process of claim 14 wherein said material is a synthetic fabric.

16. The process of claim 14 wherein said material is wood, metallic foil, plastic or a metal with a dye-receptive coating.

* * * * *